US008120554B2

(12) United States Patent
Kim

(10) Patent No.: US 8,120,554 B2
(45) Date of Patent: Feb. 21, 2012

(54) PIXEL AND ORGANIC LIGHT EMITTING DISPLAY COMPRISING THE SAME, AND DRIVING METHOD THEREOF

(75) Inventor: Hong Kwon Kim, Kyunggi-do (KR)

(73) Assignee: Samsung Mobile Display Co., Ltd. (KR)

( * ) Notice: Subject to any disclaimer, the term of this patent is extended or adjusted under 35 U.S.C. 154(b) by 1052 days.

(21) Appl. No.: 11/227,962

(22) Filed: Sep. 14, 2005

(65) Prior Publication Data

US 2006/0061529 A1 Mar. 23, 2006

(30) Foreign Application Priority Data

Sep. 15, 2004 (KR) ..... 10-2004-0073660

(51) Int. Cl.
*G09G 3/32* (2006.01)

(52) U.S. Cl. ..... 345/82

(58) Field of Classification Search ..... 345/76, 345/77, 82–84, 690, 692, 211–214; 313/497–506; 315/169.3, 169.2
See application file for complete search history.

(56) References Cited

U.S. PATENT DOCUMENTS

| | | | | |
|---|---|---|---|---|
| 6,583,775 | B1 * | 6/2003 | Sekiya et al. | 345/76 |
| 7,106,351 | B2 * | 9/2006 | Ito | 345/692 |
| 7,187,392 | B2 * | 3/2007 | Ito | 345/690 |
| 7,256,774 | B1 * | 8/2007 | Senda et al. | 345/204 |
| 7,330,162 | B2 * | 2/2008 | Yamazaki et al. | 345/82 |
| 2001/0035849 | A1 * | 11/2001 | Kimura et al. | 345/76 |
| 2002/0017643 | A1 * | 2/2002 | Koyama | 257/59 |

FOREIGN PATENT DOCUMENTS

| | | | |
|---|---|---|---|
| JP | 10-199674 | | 7/1998 |
| JP | 10-232649 | | 9/1998 |
| JP | 10-319908 | A | 12/1998 |
| JP | 10-319909 | | 12/1998 |
| JP | 11-272235 | A | 10/1999 |
| JP | 2002-72923 | A | 3/2002 |
| JP | 2002-358048 | A | 12/2002 |
| JP | 2004-085802 | A | 3/2004 |
| KR | 10-2002-0059432 | | 5/2002 |
| WO | WO 98/33165 | | 7/1998 |
| WO | WO 99/60414 | | 11/1999 |

OTHER PUBLICATIONS

Office Action issued by the Japanese Patent Office on Sep. 2, 2008 in Japanese Patent Application 2005-134653, filed Aug. 25, 2008.
Japanese Office Action dated Feb. 15, 2011 for Japanese Application No. JP 2005-134653 claiming priority to Korean Application No. KR 10-2004-0073660 which corresponds to the captioned application.
Notice of Allowance for Korean Patent Application No. 10-2004-0073660, Jul. 25, 2007.
Korean Patent Public Notice No. 10-1995-0003979 with English Abstract, Apr. 21, 1995.

* cited by examiner

*Primary Examiner* — Chanh Nguyen
*Assistant Examiner* — Tsegaye Seyoum
(74) *Attorney, Agent, or Firm* — Knobbe Martens Olson & Bear LLP

(57) ABSTRACT

An OLED pixel, an organic light emitting display comprising the same, and a driving method thereof in which a uniform image is displayed regardless of differences among transistor characteristics are disclosed. The organic light emitting display comprises a plurality of pixels connected to a plurality of scan lines, a plurality of data lines, and a plurality of power source lines. Each pixel comprises a frequency supplying line to supply a frequency signal having a frequency corresponding to a sub-frame, a pixel circuit to supply current from the power source line on the basis of a data signal and the frequency signal, and an organic light emitting diode configured to emit light depending on the output current from the pixel circuit.

5 Claims, 11 Drawing Sheets

PIXEL AND ORGANIC LIGHT EMITTING DISPLAY COMPRISING THE SAME, AND DRIVING METHOD THEREOF

CROSS-REFERENCE TO RELATED APPLICATIONS

This application claims the benefit of Korean Patent Application No. 10-2004-73660, filed on Sep. 15, 2004, in the Korean Intellectual Property Office, the disclosure of which is incorporated herein by reference.

BACKGROUND

1. Field of the Invention

The invention relates generally to display pixels and methods of driving the same. More particularly, the invention relates to a pixel representing a gradation based on frequency characteristics of an organic light emitting diode, an organic light emitting display comprising the same, and a driving method thereof.

2. Discussion of Related Art

Recently, various flat panel displays have been developed as substitutes for a cathode ray tube (CRT) display due to their bulkiness and excessive weight. Types of flat panel displays include a liquid crystal display (LCD), a field emission display (FED), a plasma display panel (PDP), and an organic light emitting display (LED).

An organic light emitting display emits light independently using recombination of an electron and a hole, and is classified into two types: an inorganic light emitting display comprising an inorganic emission layer, and an organic light emitting display comprising an organic emission layer. The organic light emitting display can also be referred to as an electroluminescent display.

In contrast to a passive type display that requires a separate light source like the LCD, an organic light emitting display has an advantageously fast response time like a cathode ray tube (CRT) display.

FIG. 1 is a circuit diagram of a pixel provided in an organic light emitting display. Referring to FIG. 1, the exemplary organic light emitting display comprises a plurality of pixels 11 positioned at an intersection region of a scan line Sn and a data line Dm. An individual pixel 11 is selected when a scan signal is applied to a scan line Sn, and the selected pixel 11 emits light in response to a data signal applied to the data line Dm.

Each pixel 11 comprises a first power source line VDD, a second power source line VSS, an organic light emitting diode (OLED), and a pixel circuit 40.

The OLED comprises an anode electrode connected to the pixel circuit 40, and a cathode electrode connected to the second power source line VSS.

The organic light emitting diode comprises an emitting layer, an electron transport layer, and a hole transport layer, which are interposed between the anode electrode and the cathode electrode. Additionally, the organic light emitting diode may comprise an electron injection layer, and a hole injection layer. In such an organic light emitting diode, when voltage is applied across the anode electrode and the cathode electrode, electrons generated from the cathode electrode are moved to the emitting layer via the electron injection layer and the electron transport layer, and holes generated from the anode electrode are moved to the emitting layer via the hole injection layer and the hole transport layer. The electrons from the electron transport layer and the holes from the hole transport layer are then recombined in the emitting layer, thereby emitting light.

Referring again to FIG. 1, the pixel circuit 40 comprises a first transistor M1, a second transistor M2, and a capacitor C. The first and second transistors M1 and M2 are of a p-type metal oxide semiconductor (PMOS) field effect transistor (FET). In the illustrated example, the second power source VSS has a voltage level lower than that of first power source VDD, where the second power source VSS may be coupled to ground.

The first transistor M1 comprises a gate electrode connected to the scan line Sn, a source electrode connected to the data line Dm, and a drain electrode connected to a first node N1. In the illustrated example, the first transistor M1 supplies the data signal from the data line Dm to the first node N1 in response to the scan signal transmitted through the scan line Sn.

The capacitor C stores voltage corresponding to the data signal transmitted to the first node N1 through the first transistor M1 while the scan signal is supplied to the scan line Sn, and then maintains the second transistor M2 to be turned on for one frame when the first transistor M1 is turned off.

The second transistor M2 comprises a gate electrode connected to the first node N1 to which the drain electrode of the first transistor M1 and the capacitor C are commonly connected, a source electrode connected to the first power source line VDD, and a drain electrode connected to the anode electrode of the organic light emitting diode OLED. In operation, the second transistor M2 adjusts the intensity of current on the basis of the data signal supplied from the first power source line VDD to the organic light emitting diode OLED. Thus, the OLED emits light based on the current supplied from the first power source line VDD through the second transistor M2.

The pixel 11 thus operates as follows. When a low state scan signal is transmitted to the scan line Sn, the first transistor M1 is turned on. Then, the data signal is supplied from the data line Dm to the gate electrode of the second transistor M2 via the first transistor M1 and the first node N1. At this time, the capacitor C stores a voltage corresponding to the voltage difference between the gate electrode of the second transistor M2 and the first power source line VDD.

In response to the voltage applied to the first node N1, the second transistor M2 is turned on and supplies a current, corresponding to the data signal, to the OLED. Thus, the OLED emits light based on the current supplied from the second transistor M2, and thereby displays an image.

When a high state scan signal is transmitted to the scan line Sn, the voltage that corresponds to the data signal is stored in the capacitor C and maintains the second transistor M2 to be turned on for one frame. Accordingly, the organic light emitting diode OLED emits light for one frame, thereby displaying an image.

Further, the exemplary organic light emitting display may additionally comprise a compensation circuit (not shown) to compensate for the non-uniformity of the threshold voltages of a plurality of second transistors (e.g., the second transistor M2) due to a manufacturing process. Although the organic light emitting display comprising the compensation circuit may operate in an offset compensation manner or a current programming manner, there are still limitations to the display of an image with uniform brightness.

SUMMARY OF THE INVENTION

Accordingly, it is an aspect of the invention to provide a pixel, an organic light emitting display comprising the same and a driving method thereof, in which an uniform image is displayed regardless of differences between transistor characteristics.

The foregoing and/or other aspects of the present invention are achieved by providing an organic light emitting display comprising a plurality of scan lines for supplying a scan signal, a plurality of data lines for supplying a data signal, a plurality of power source lines, and a plurality of pixels connected to the plurality of scan lines, the plurality of data lines, and the plurality of power lines, wherein each pixel comprises: a frequency supplying line to supply a frequency signal having frequency corresponding to a sub-frame; a pixel circuit to supply current from the power source line on the basis of the data signal and the frequency signal; and an organic light emitting diode to emit light depending on the current outputted from the pixel circuit.

According to an aspect of the invention, each pixel represents gradation on the basis of a brightness sum of light emitted from the organic light emitting diode in each sub-frame. Further, the data signal includes a digital data signal having i bits corresponding to each sub-frame, where i is a positive integer. Also, the frequency of the frequency signal becomes lower as the bit of the digital data signal approaches a most significant bit.

Other aspects of the invention are achieved by providing an organic light emitting display comprising: a pixel portion comprising a plurality of pixels defined by a plurality of scan lines, a plurality of data lines, a plurality of power source lines and a plurality of frequency supplying lines, and configured to emit light on the basis of a data signal transmitted through the data line and a frequency signal transmitted through the frequency supplying line; a data driver configured to supply the data signal to the data line; a scan driver configured to supply the scan signal to the scan line; and a frequency supply configured to supply the frequency signal to the frequency supplying line.

Still other aspects of the invention are achieved by providing a pixel comprising: a pixel circuit configured to output current corresponding to a data signal and a frequency signal; and an organic light emitting diode configured to emit light based on the current output from the pixel circuit.

According to an aspect of the invention, the frequency of the frequency signal is reduced as the bit of the digital data signal approaches a most significant bit. In some embodiments, the pixel further comprises a scan line through which the scan signal is supplied; a data line through which the digital data signal is supplied; and a power source line through which a driving voltage is supplied.

Yet other aspects of the invention are achieved by providing a method of driving a pixel, comprising: outputting current depending on a data signal and a frequency signal; and controlling an organic light emitting diode on the basis of the output current.

According to an aspect of the invention, outputting the current comprises storing the data signal supplied through a data line in response to a scan signal transmitted through a scan line; and outputting current from a power source line in correspondence to the stored data signal and the frequency signal transmitted through a frequency supplying line.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF CERTAIN INVENTIVE EMBODIMENTS

Figure 1:
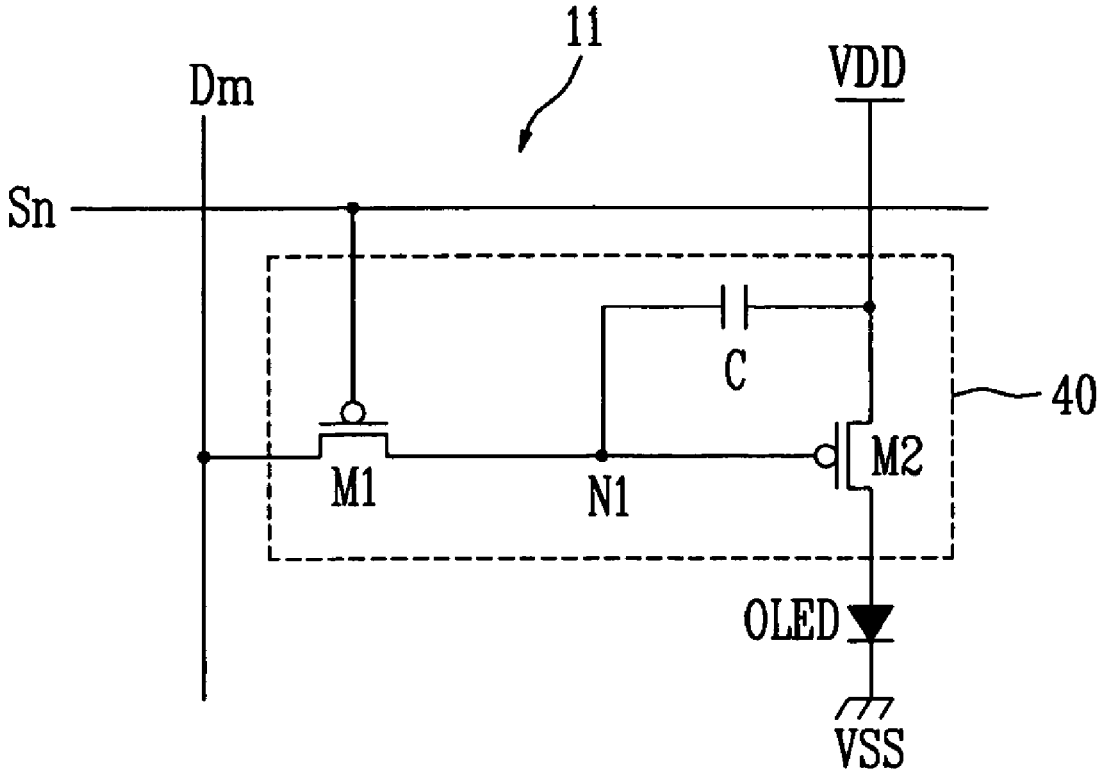
FIG. 1 (PRIOR ART)
FIG. 1 is an exemplary circuit diagram of a pixel provided in an organic light emitting display.

Hereinafter, certain embodiments according to the invention will be described with reference to the accompanying drawings, wherein like reference numerals refer to like elements throughout.

Figure 2:
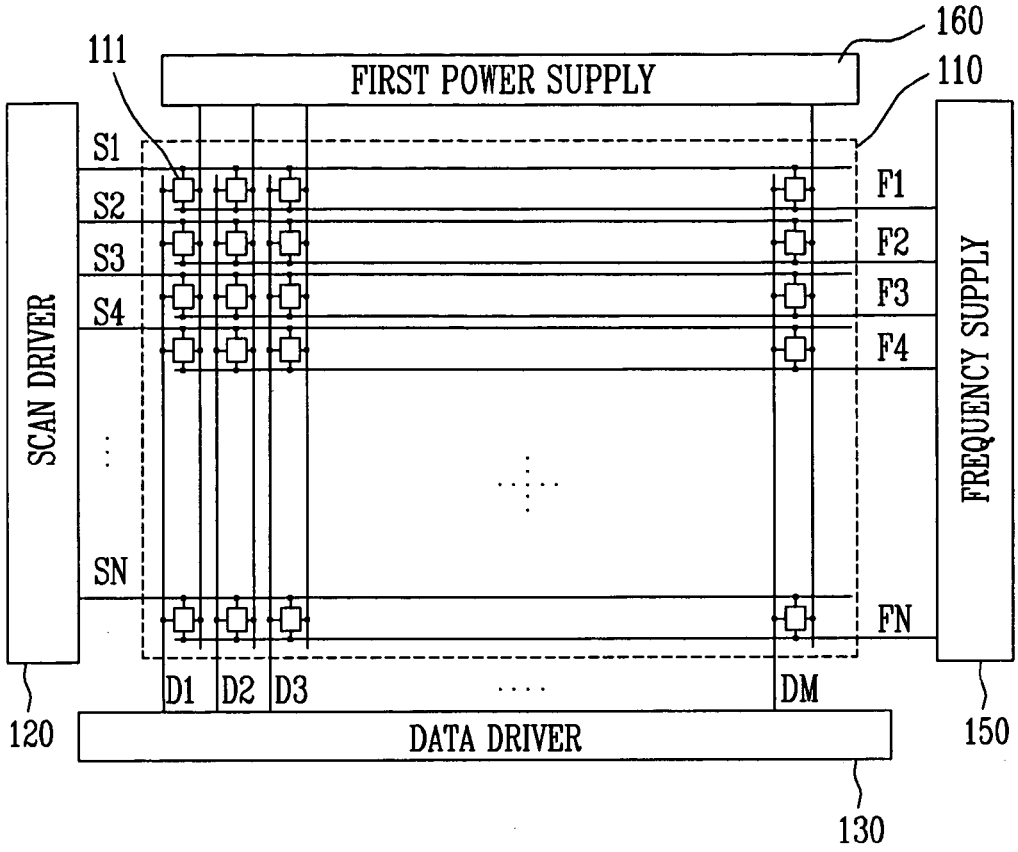
FIG. 2 illustrates an organic light emitting display comprising a pixel according to a first embodiment of the invention.

FIG. 2 illustrates an organic light emitting display comprising a pixel according to a first embodiment of the invention.

Referring to FIG. 2, the illustrated pixel comprises a pixel portion 110, a scan driver 120, a data driver 130, a first power supply 160, and a frequency supply 150.

The pixel portion 110 comprises a plurality of pixels 111, wherein the pixels 11 are defined by a plurality of scan lines S1 through SN, a plurality of data lines D1 through DM, a plurality of pixel power source lines, and a plurality of frequency supplying lines F1 through FN. In one embodiment, the plurality of pixels 111 receives second power from a second power supply (not shown), wherein the second power is different from the first power.

The pixel 111 is selected when a scan signal is transmitted to the scan line S1 through SN, and emits light corresponding to a data signal transmitted to the data line DM and a frequency signal transmitted to the frequency supplying lines F1 through FN. Specifically, the pixel 111 controls brightness of the organic light emitting diode (OLED) that emits light based on the digital data signal and the frequency signal, thereby displaying an image with desired gradation.

The scan driver 120 generates the scan signal in response to scan control signals, such as a start pulse and a clock signal transmitted from a controller (not shown), and supplies the scan signals to the scan lines S1 through SN in sequence, thereby sequentially driving the scan lines S1 through SN.

The data driver 130 supplies the digital data signal of i bits to the respective pixels 111 through the data lines D1 through DM in response to a data control signal supplied from the controller. That is, the data driver 130 supplies each digital data signal of i bits to the data lines D1 through DM per j sub-frames, where j is a positive integer equal to or larger than i. Here, the least significant bit (LSB) digital data signal among the digital data signals of i bits is supplied to a first sub-frame.

The first power supply 160 is configured to supply the first power to the pixel power source line of the pixel portion 110. The frequency supply 150 is configured to generate the frequency signals, different from each other, for every sub-frame corresponding to each bit of the i bit digital data signals, and to supply the frequency signal to the frequency supplying lines F1 through FN. In one embodiment, the frequency of the frequency signal generated by the frequency supply 150 becomes lower as the i bit of the digital data signal approaches the most significant bit. In addition, the frequency signal supplied to the frequency supplying lines F1 through FN is synchronized with the scan signal supplied to the scan line.

Figure 3:
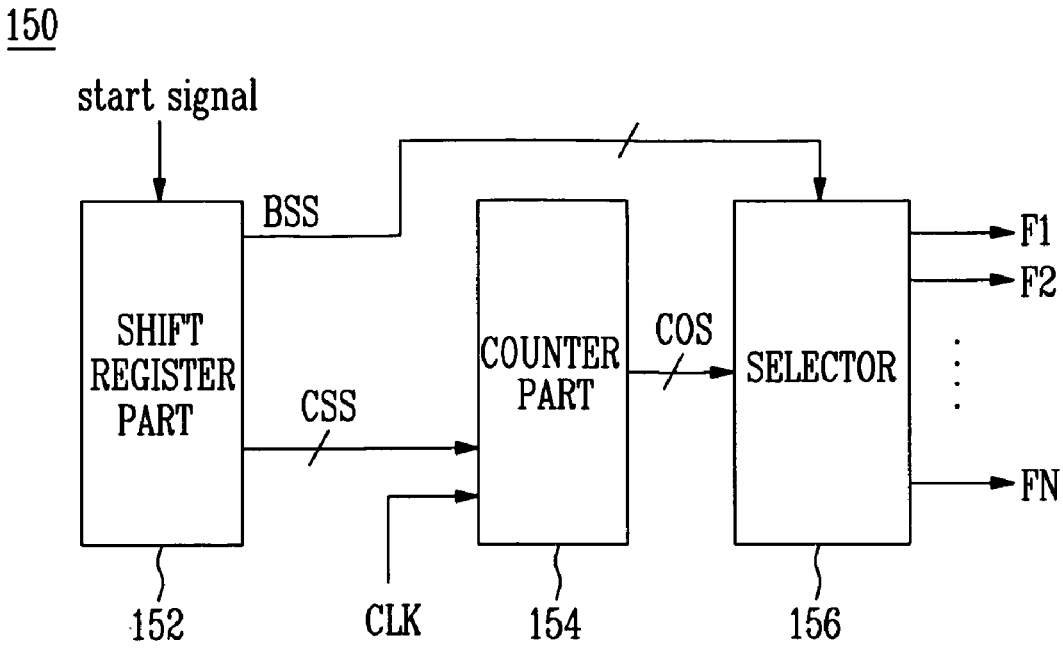
FIG. 3 is a block diagram showing a first embodiment of the frequency supply illustrated in FIG. 2.

FIG. 3 is a block diagram illustrating a first embodiment of the frequency supply illustrated in FIG. 2. Referring to FIG. 3 in accordance with FIG. 2, the frequency supply 150 comprises a shift register part 152, a counter part 154, and a selector 156.

The shift register part 152 comprises a plurality of shift registers. Each shift register of 152 sequentially shifts a starting signal synchronized with the scan signal, thereby supplying it to the counter 154 and the selector 156. Each shift register generates a count starting signal CSS and supplies it to the counter 154. In addition, each shift register sequentially shifts k bits (where k is a positive integer) and generates a bit selection signal BSS, and supplies the BSS to the selector 156. When an 8 bit digital data signal and eight sub-frames are provided, for example, each shift register generates the bit selection signal of 3 bits BSS and supplies it to the selector 156.

The counter part 154 comprises a plurality of p bit counters (where p is a positive integer). Each counter is started by the count starting signal CSS from the shift register part 152, and generates a plurality of count output signals COS having different frequencies according to one or more input clock signals (CLK), thereby supplying the count output signals COS to the selector 156.

The selector 156 comprises a plurality of bit selectors. In one embodiment, each bit selector is realized by an analog switch. Each bit selector, corresponding to the bit selection signal BSS, selects one of the count output signals COS supplied from each counter at the counter part 154, and supplies the selected count output signals COS to the frequency supplying lines F1 through FN in sequence. Thus, the selector 156 generates the different frequency signals according to sub-frames and supplies them to the frequency supplying lines F1 through FN. In one embodiment, the selector 156 selects a lower frequency signal among i bit digital data signals as the bit gets closer to the most significant bit, thereby supplying the signals to the frequency supplying lines F1 though FN in sequence.

Figure 4:
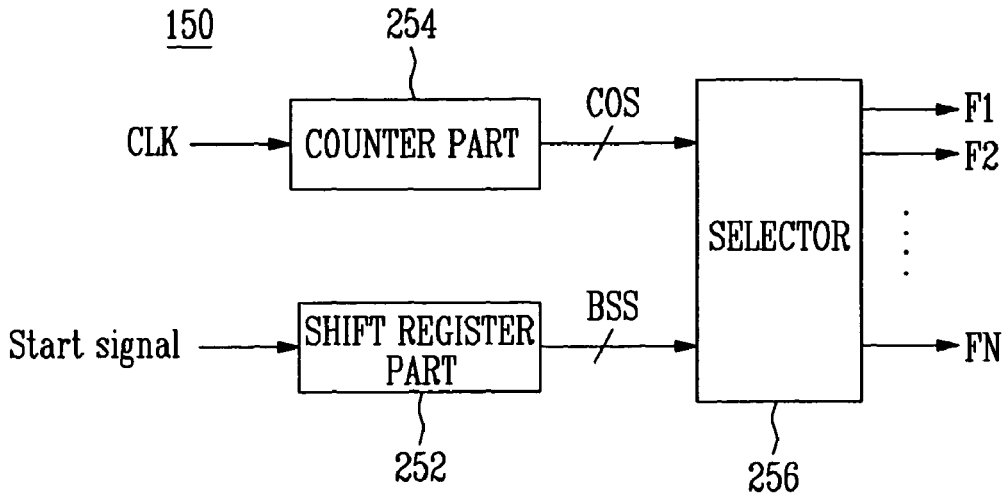
FIG. 4 is a block diagram showing a second embodiment of the frequency supply illustrated in FIG. 2.

FIG. 4 is a control block diagram showing a second embodiment of the frequency supply illustrated in FIG. 2. Referring to FIG. 4 in accordance with FIG. 2, the frequency supply 150 comprises a counter part 254, a shift register part 252, and a selector 256.

The counter part 254 is started by a count starting signal and generates a plurality of count output signals COS having different frequencies according to input clock signals (CLK), wherein the count output signals COS are supplied to the selector 256. In one embodiment, the count output signals COS generated by the counter 254 have different frequencies corresponding to the respective bits (or each sub-frame) among the i bit digital data signals.

Each shift register is configured to sequentially shift a starting signal synchronized with the scan signal, thereby supplying the shifted starting signal to the selector 256. Specifically, each shift register outputs a bit selection signal BSS to the selector 256. In one embodiment, each shift register sequentially shifts k bits and generates the voltage selection signal VSSS, thereby generates the bit selection signal BSS. When an 8 bit digital data signal and eight sub-frames are provided, for example, each shift register generates the bit selection signal BSS of 3 bits and supplies it to the selector 156.

The selector 256 comprises a plurality of bit selectors, wherein each bit selector may be realized by an analog switch, for example. Each bit selector is configured to select one of the count output signals COS having different frequencies according to the bit selection signals supplied from the respective shift register. Each bit selector is further configured to supply the selected count output signals COS to the frequency supplying lines F1 through FN in sequence. Thus, the selector 156 generates the different frequency signals according to the respective sub-frames, and supplies the different frequency signals to the frequency supplying lines F1 through FN. In one embodiment, the selector 156 selects a lower frequency signal among digital data signals of i bits as the bit approaches the most significant bit, thereby supplying the signals to the frequency supplying lines F1 though FN in sequence.

Figure 5:
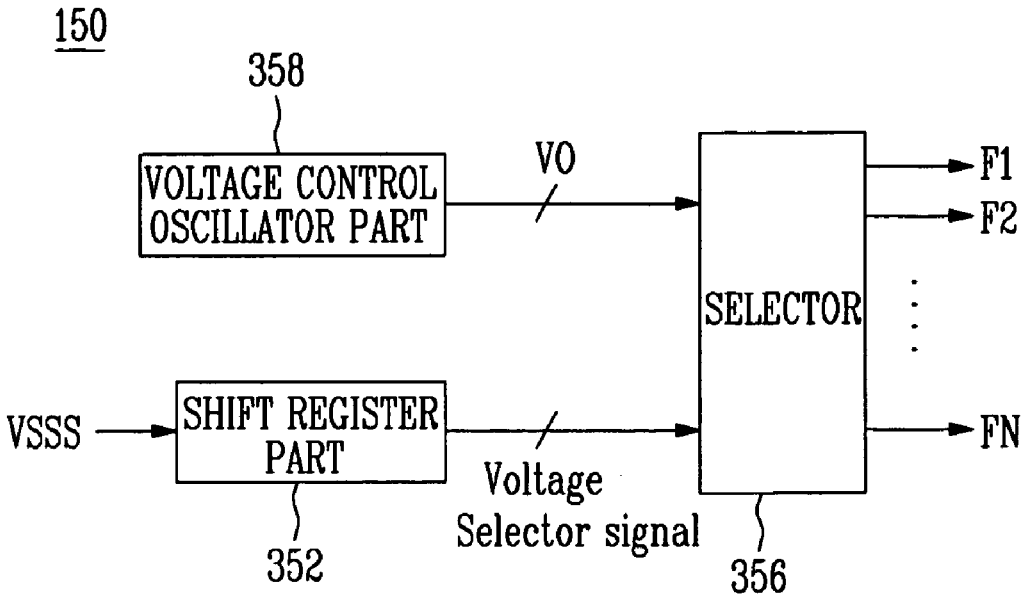
FIG. 5 is a block diagram showing a third embodiment of the frequency supply illustrated in FIG. 2.

FIG. 5 is a block diagram illustrating a third embodiment of the frequency supply illustrated in FIG. 2. Referring to FIG. 5 in accordance with FIG. 2, the frequency supply 150 comprises a voltage controlled oscillator circuit 358, a shift register part 352, and a selector 356.

The voltage controlled oscillator circuit 358 comprises a plurality of voltage controlled oscillators. Each voltage controlled oscillator generates a plurality of different frequency signals VO based on different supply voltages, and supplies the frequency signals VO to the selector 356. Specifically, the voltage controlled oscillator circuit 358 generates a lower frequency signal VO as a bit among the digital data signals of i bits approaches the most significant bit, and supplies the frequency signal VO to the selector 356.

The shift register part 352 comprises a plurality of shift registers. Each shift register is configured to sequentially shift a voltage selection signal VSSS synchronized with the scan signal, and supply the voltage selector signal to the selector 356. Specifically, each shift register outputs a sequentially shifted voltage selection signal to the selector 356. Each shift register sequentially shifts k bits and generates the voltage selection signal VSSS and supplies the shifted signal to the selector 356. When an 8 bit digital data signal and eight sub-frames are provided, for example, each shift register generates the voltage selection signal of 3 bits and supplies it to the selector 356.

The selector 356 comprises a plurality of voltage selectors, wherein each voltage selector may be realized by an analog switch. Each voltage selector is configured to select one of the different frequency signals VO supplied from the voltage controlled oscillator 358 according to the voltage selection signals supplied from the shift register 352. The selector 356 is configured to supply the selected frequency signals to the frequency supplying lines F1 through FN in sequence. The selector 356 selects the different frequency signals according to the respective sub-frames and supplies the selected signals to the frequency supplying lines F1 through FN. The selector 356 selects a lower frequency signal among digital data signals of i bits as the bit approaches the most significant bit, thereby supplying the different frequency signals VO to the frequency supplying lines F1 though FN in sequence.

Figure 6:
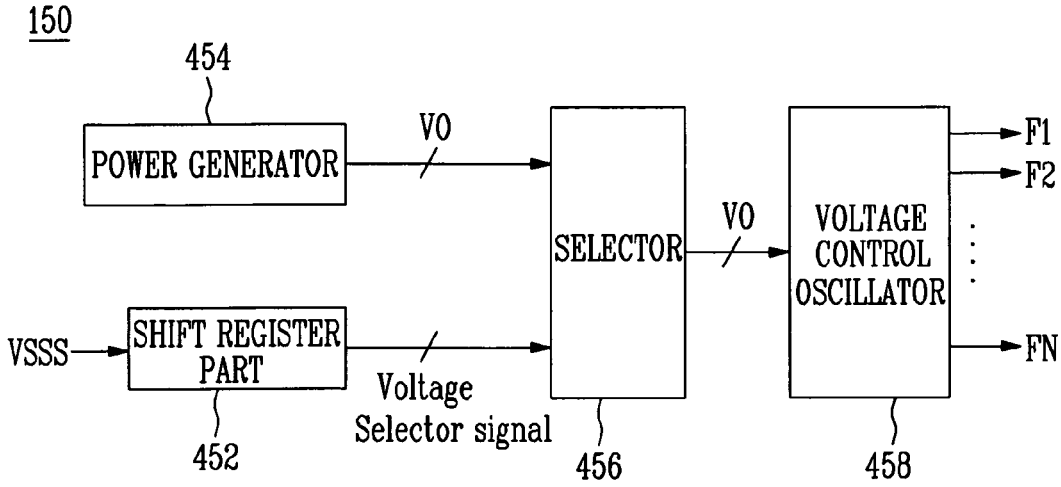
FIG. 6 is a block diagram showing a fourth embodiment of the frequency supply illustrated in FIG. 2.

FIG. 6 is a block diagram showing a fourth embodiment of the frequency supply illustrated in FIG. 2. Referring to FIG. 6 in accordance with FIG. 2, the frequency supply 150 comprises a power generator 454, a shift register part 452, a selector 456, and a voltage controlled oscillator circuit 458.

The power generator 454 is configured to generate a plurality of voltages VO with different voltage levels, and supply the voltages VO to the selector 456. The shift register part 452 comprises a plurality of shift registers. Each shift register is configured to sequentially shift a voltage selection signal VSSS synchronized with the scan signal, and supply the shifted signal to the selector 456. Specifically, each shift register outputs the sequentially shifted voltage selection signal to the selector 456. Each shift register sequentially shifts k bits and [generates the voltage selection signal VSSS,] thereby supplying it to the selector 456. When an 8 bit digital data signal and eight sub-frames are provided, for example, each shift register generates a voltage selection signal of 3 bits and supplies it to the selector 456.

The selector 456 comprises a plurality of voltage selectors, wherein each voltage selector may be realized by an analog switch. Each voltage selector is configured to select one of the different voltages VO supplied from the power generator 454 according to the voltage selection signals supplied from the respective shift registers at the shift register 452. Each voltage selector supplies the selected voltage to the voltage controlled oscillator 458.

The selector 356 is configured to select the different frequency signals according to the respective sub-frames, and supplies the selected signal to the frequency supplying lines F1 through FN. In one embodiment, the selector 356 selects a lower frequency signal among digital data signals of i bits as the bit approaches the most significant bit, thereby supplying it to the frequency supplying lines F1 though FN in sequence.

The voltage controlled oscillator circuit 458 comprises a plurality of voltage controlled oscillators. Each voltage controlled oscillator is configured to generate frequencies corresponding to the voltages selected by the selector, and supply them to the frequency supplying lines F1 through FN in sequence. Thus, the voltage controlled oscillator 458 generates the different frequencies according to the respective sub-frames and supplies them to the frequency supplying lines F1 through FN. In one embodiment, the voltage controlled oscillator 458 selects a lower frequency signal among the digital data signals of i bits as the bit approaches the most significant bit, thereby supplying the different frequency signals to the frequency supplying lines F1 though FN in sequence.

Figure 7:
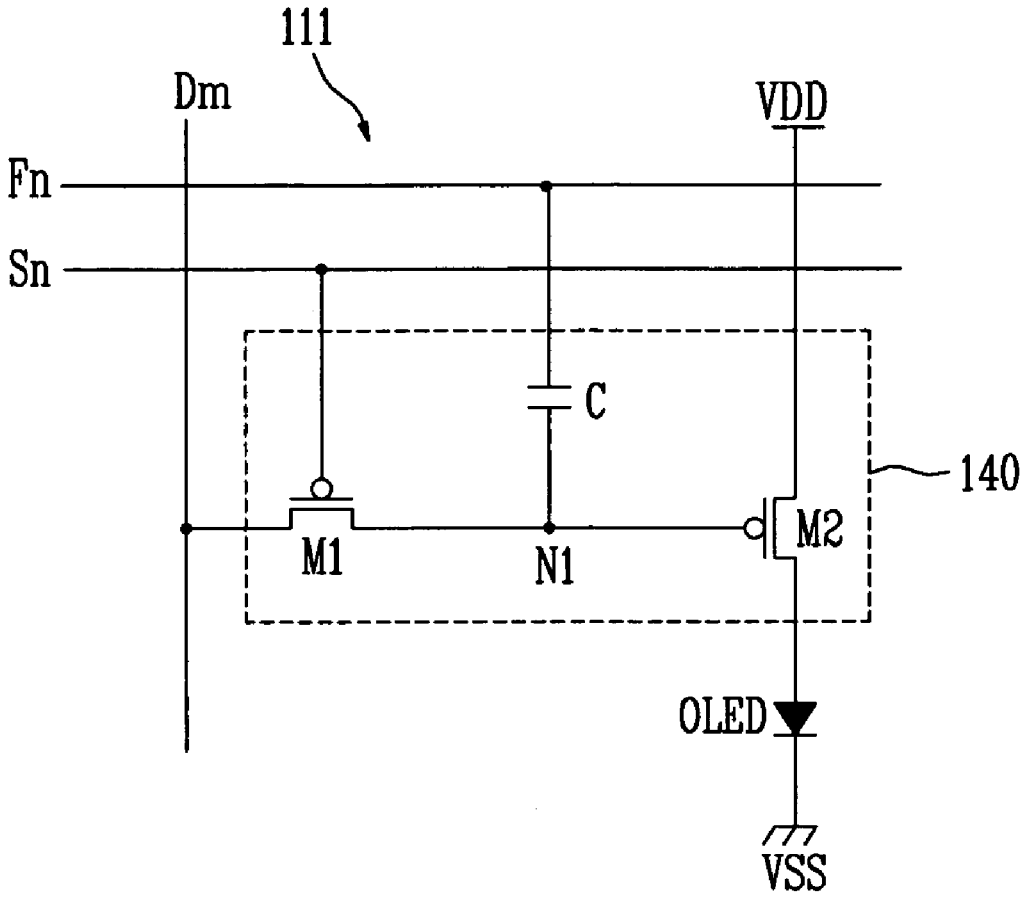
FIG. 7 is a circuit diagram of the pixel illustrated in FIG. 2.

FIG. 7 is a circuit diagram of one embodiment of the pixel illustrated in FIG. 2. Referring to FIG. 7 in accordance with FIG. 2, each pixel 111 provided in the organic light emitting display comprises the first power source line VDD, the second power source line VSS, the organic light emitting diode (OLED), and the pixel circuit 140.

The OLED comprises an anode electrode connected to the pixel circuit 140, and a cathode electrode connected to the second power source line VSS.

In one embodiment, the OLED comprises an emitting layer, an electron transport layer, and a hole transport layer, all of which are interposed between an anode electrode and a cathode electrode. Additionally, the OLED may comprise an electron injection layer, and a hole injection layer. In one embodiment of the organic light emitting diode, when voltage is applied between the anode electrode and the cathode electrode, electrons generated from the cathode electrode are moved to the emitting layer via the electron injection layer and the electron transport layer, and holes generated from the anode electrode are moved to the emitting layer via the hole injection layer and the hole transport layer. The electrons from the electron transport layer and the holes from the hole transport layer are then recombined in the emitting layer, thereby emitting the light.

Referring again to FIG. 7, the pixel circuit 140 comprises a first transistor M1, a second transistor M2, and a capacitor C. In one embodiment, the first and second transistors M1 and M2 are of a p-type metal oxide semiconductor field effect transistor (PMOS FET). When the pixel circuit 140 is configured with the PMOS FET, the second power source line VSS may have a voltage level lower than that of the first power VDD. For example, the second power source line VSS may be coupled to ground.

The first transistor M1 comprises a gate electrode connected to the scan line Sn, a source electrode connected to the data line Dm, and a drain electrode connected to a first node N1. In operation, the first transistor M1 supplies the data signal from the data line Dm to the first node N1 in response to the scan signal transmitted through the scan line Sn.

The second transistor M2 comprises a gate electrode connected to the first node N1, wherein the drain electrode of the first transistor M1 and a capacitor C are also commonly connected to the first node N1. The second transistor M2 further comprises a source electrode connected to the first power source line VDD, and a drain electrode connected to the anode electrode of the organic light emitting diode (OLED). In operation, the second transistor M2 adjusts the intensity of current flowing from the first power source line VDD to the OLED based on the voltages supplied from the capacitor C to the gate electrode of the second transistor M2.

The capacitor C comprises a first electrode connected to the first node N1, which is also coupled to the gate electrode of the second transistor M2, and a second electrode connected to the frequency supplying line Fn, through which the frequency signal is supplied. In operation, the capacitor C stores the digital data signal transmitted to the first node N1 through the first transistor M1 while the scan signal is transmitted to the scan line Sn, and then turns the second transistor M2 on/off in correspondence to the frequency signal supplied from the frequency supplying line Fn when the first transistor M1 is turned off. For example, the capacitor C stores the voltage corresponding to the digital data signal of "1" when the digital data signal of "1" is supplied to the data line Dm while the scan signal is supplied to the scan line Sn, and then turns off the second transistor M2 in correspondence to the stored voltage when the first transistor M1 is turned off by the scan signal. When the digital data signal of "0" is supplied to the data line Dm while the scan signal is supplied to the scan line Sn, the capacitor C stores the voltage corresponding to the digital data signal of "0", and then turns the second transistor M2 on/off in correspondence to the frequency signal supplied from the frequency supplying line Fn when the first transistor M1 is turned off by the scan signal.

Thus, the OLED has capacitance, and therefore emits light based on the current supplied by the second transistor M2, which is turned on/off according to the frequency characteristics of the signal supplied on the frequency supply line Fn.

Figure 8:
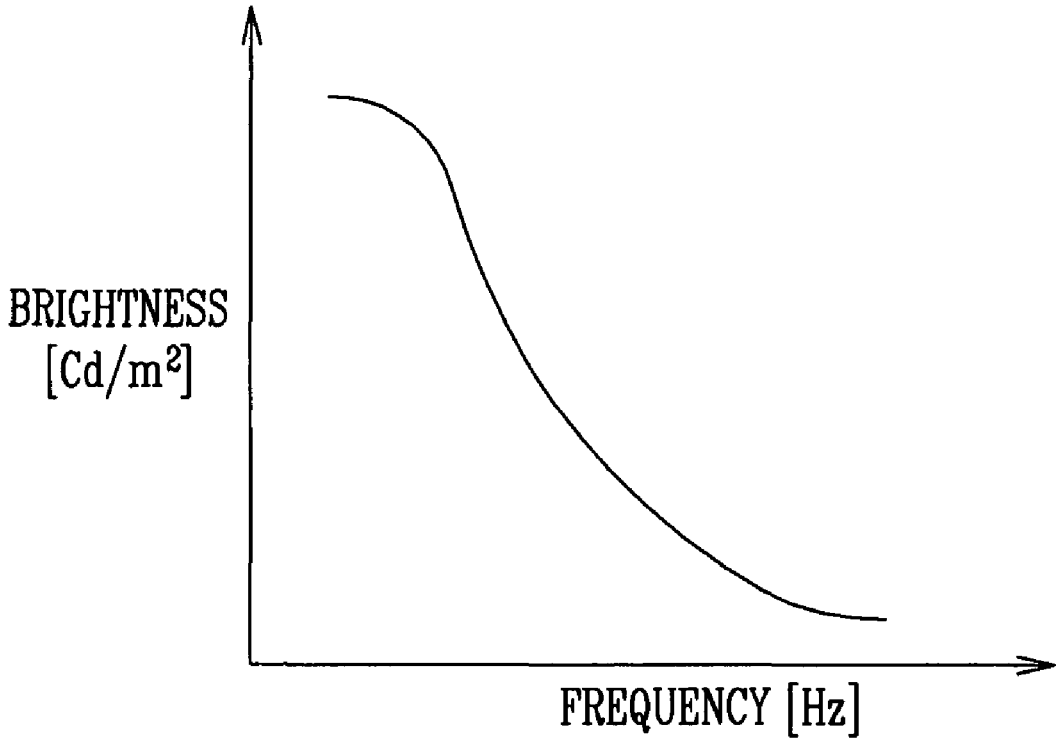
FIG. 8 is a graph showing the brightness of an organic light emitting diode illustrated in FIG. 7 with respect to frequency.

FIG. 8 is a graphical illustration of the brightness ($Cd/m^2$) with respect to frequency (Hz) of one embodiment of the OLED of the pixel circuit illustrated in FIG. 7.

Referring to FIG. 8, the capacitance of the OLED is lower at a high frequency (Hz) and higher at a low frequency, therefore passing a low frequency (Hz) signal. Thus, when a low frequency (Hz) signal is input to the OLED, the OLED emits light with a relatively high brightness level ($Cd/M^2$). In contrast, when a high frequency (Hz) signal is input to the OLED, the OLED emits light with a relatively low brightness level ($Cd/M^2$).

Figure 9:
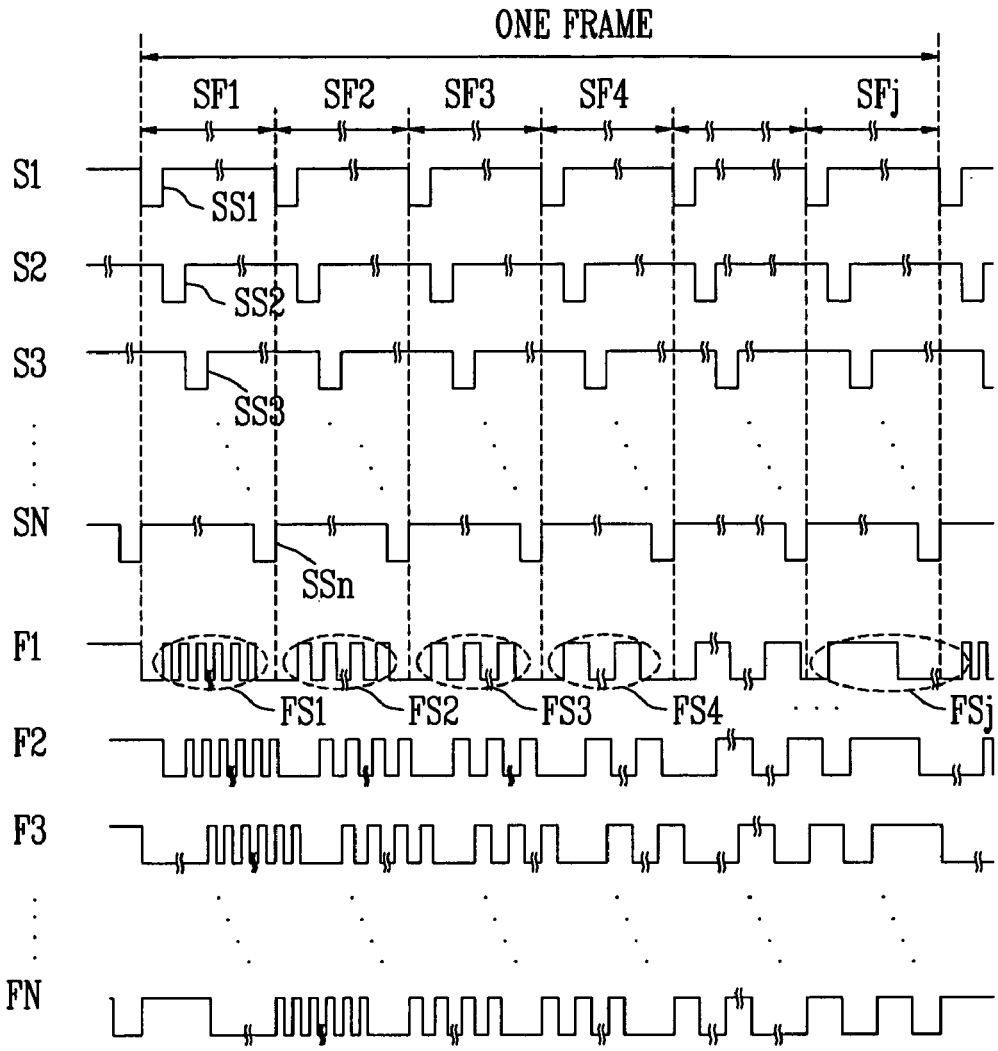
FIG. 9 shows waveforms of signals for driving the organic light emitting display comprising the pixel according to the first embodiment.

FIG. 9 shows waveforms of drive signals for the organic light emitting display comprising the pixel according to the first embodiment. Referring to FIG. 9 in accordance with FIG. 7, the organic light emitting display comprising the pixel according to the first embodiment of the invention operates by dividing one frame into j sub-frames SF1 through SFj corresponding to the respective bits of the digital data signals of i bits and having the same emission period, in order to represent a desired gradation by controlling the brightness. At this time, the $1^{st}$ through $j^{th}$ sub-frames (SF1 through SFj) have gradations corresponding to differently weighted brightness. In the present embodiment, the gradation rates corresponding to the brightness of the $1^{st}$ through $j^{th}$ sub-frames (SF1 through SFj) are $2^0:2^1:2^2:2^3:2^4:2^5:\ldots:2^j$, respectively.

According to the first embodiment of the present invention, the organic light emitting display comprising the pixel is operated as follows. First, in the $1^{st}$ sub-frame SF1 of one frame, low scan signals SS1 through SSN are sequentially transmitted to the scan lines S1 through SN, and at the same time, first level voltages are sequentially applied from the respective frequency supplying lines F1 through FN to the second electrode of the capacitor C (see FIG. 7). Therefore, the first transistors M1 connected to the respective scan lines S1 through SN are turned on in sequence, so that the $1^{st}$ bit digital data signal among i bits digital data signals is supplied to the gate electrode of each second transistor M2 via the first transistor M1 and the first node N1. At this time, each capacitor C stores a voltage corresponding to the difference between the first level voltage and the $1^{st}$ digital data signal of the first node N1.

Following supply of the low scan signals, high scan signals SS1 through SSN are sequentially supplied to the respective scan lines S1 through Sn, and the $1^{st}$ frequency signal FS1 alternating between the first level and the second level is supplied from each frequency supplying line F to the second electrode of each capacitor C. Therefore, each capacitor C turns the second transistor M2 on/off according to the $1^{st}$ frequency signal FS1, thereby supplying the current from the first power source line VDD to the OLED.

Thus, in the $1^{st}$ sub-frame SF1, the OLED emits light corresponding to the current supplied on the basis of the switching operation of the second transistor M2. In response to the supplied current, the capacitance of the OLED lowers the high frequency but passes the low frequency. With this frequency characteristics, the organic light emitting diode OLED emits light based on the frequency of the current supplied through the second transistor M2. In the $1^{st}$ sub-frame SF1, the OLED emits light with a brightness based on the brightness between the "0" and "$2^0$" gradations according to the current corresponding to the $1^{st}$ bit digital data signal. That is, the OLED emits light with a brightness corresponding to the "$2^0$" gradation when the $1^{st}$ bit digital data signal is "0", but does not emit light when the $1^{st}$ bit digital data signal is "1".

In the $2^{nd}$ sub-frame SF2 of one frame, the low scan signals SS1 through SSn are sequentially transmitted to the scan lines S1 through SN (see FIG. 9), and at the same time, first level voltages are sequentially applied from the respective frequency supplying lines F1 through FN to the second electrode of the capacitor C. In response to the scan signals, the first transistors M1 connected to the respective scan lines S1 through SN are turned on in sequence, so that the $2^{nd}$ bit digital data signal among i bits digital data signals is supplied to the gate electrode of each second transistor M2 via the first transistor M1 and the first node N1 (see FIG. 7). At this time, each capacitor C stores a voltage corresponding to the difference between the first level voltage and the $2^{nd}$ digital data signal at the first node N1.

Following transmission of the low scan signals, the high scan signals SS1 through SSN are sequentially supplied to the respective scan lines S1 through Sn, and the $2^{nd}$ frequency signal FS2, lower than the $1^{st}$ frequency signal FS1 and alternating between the first level and the second level, is supplied from each frequency supplying line F to the second electrode of each capacitor C. Each capacitor C turns the second transistor M2 on/off according to the $2^{nd}$ frequency signal FS2, thereby supplying the current from the first power source line VDD to the OLED.

In the $2^{nd}$ sub-frame SF2, the OLED emits light corresponding to the supplied current on the basis of the switching operation of the second transistor M2. Thus, the OLED emits light based on the frequency of the current supplied through the first frequency power source line VDD according to the frequency characteristics of the signal, which controls the switching operation of the second transistor M2. In the $2^{nd}$ sub-frame SF2, the OLED emits light with a brightness based on a brightness between "0" and "$2^1$" gradations according to the current corresponding to the $2^{nd}$ bit digital data signal. That is, the OLED emits light with a brightness corresponding to the "$2^1$" gradation when the $2^{nd}$ bit digital data signal is "0", but does not emit light when the $2^{nd}$ bit digital data signal is "1".

In the $3^{rd}$ sub-frame SF3, the OLED emits light in a manner similar to that described with respect to the first and second sub-frames. Specifically, the OLED emits light on the basis of the frequency of the current flowing from the first power source line VDD, wherein the second transistor M2 is turned on/off by the $3^{rd}$ frequency signal, which has a lower frequency than the $2^{nd}$ frequency signal FS2. Thus, in the $3^{rd}$ sub-frame SF3, the OLED emits light with a brightness based on a brightness between "0" and "$2^2$" gradations according to the current corresponding to the $3^{rd}$ bit digital data signal. That is, the OLED emits light with a brightness corresponding to the "$2^2$" gradation when the $3^{rd}$ bit digital data signal is "0", but does not emit light when the $3^{rd}$ bit digital data signal is "1".

Similarly, in the $4^{th}$ through $j^{th}$ sub-frames SF4 through SFj of one frame, the OLED emits light based on the current flowing from the first power source line VDD as the second transistor M2 is turned on/off by the $4^{th}$ through $j^{th}$ frequency signals FS4 through FSj. The frequencies of the signals FS4 through FSj get lower in the same manner as described above, such that the OLED emits light with a brightness corresponding to either "0" or "$2^2$" through "$2^i$" gradations.

Thus, in the organic light emitting display comprising the pixel according to the first embodiment of the invention, desired gradations are represented by the sum of weighted brightness in the respective sub-frames SF1 through SFj on the basis of the frequency characteristics of the OLED. Thus, the light emitting display employs emission time of the pixel instead of the voltage to represent the gradation. Thereby, an image is more uniformly displayed as compared to prior art light emitting displays, regardless of whether the pixel circuit transistors have non-uniform threshold voltages. Further, according to one embodiment, the sub-frames SF1 through SFj corresponding to the digital data signals of i bits are equalized in the emission period, thereby securing sufficient time for gradation representation.

Figure 10:
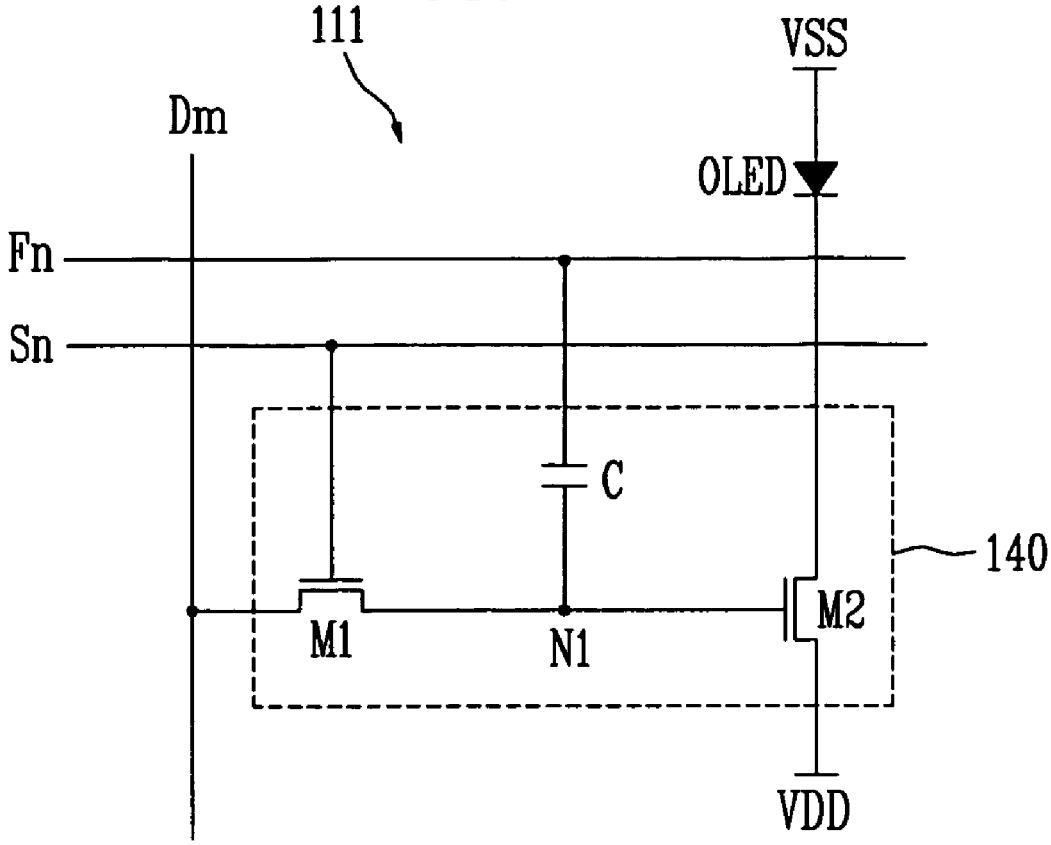
FIG. 10 is a circuit diagram of a pixel provided in an organic light emitting display according to a second embodiment.
Figure 11:
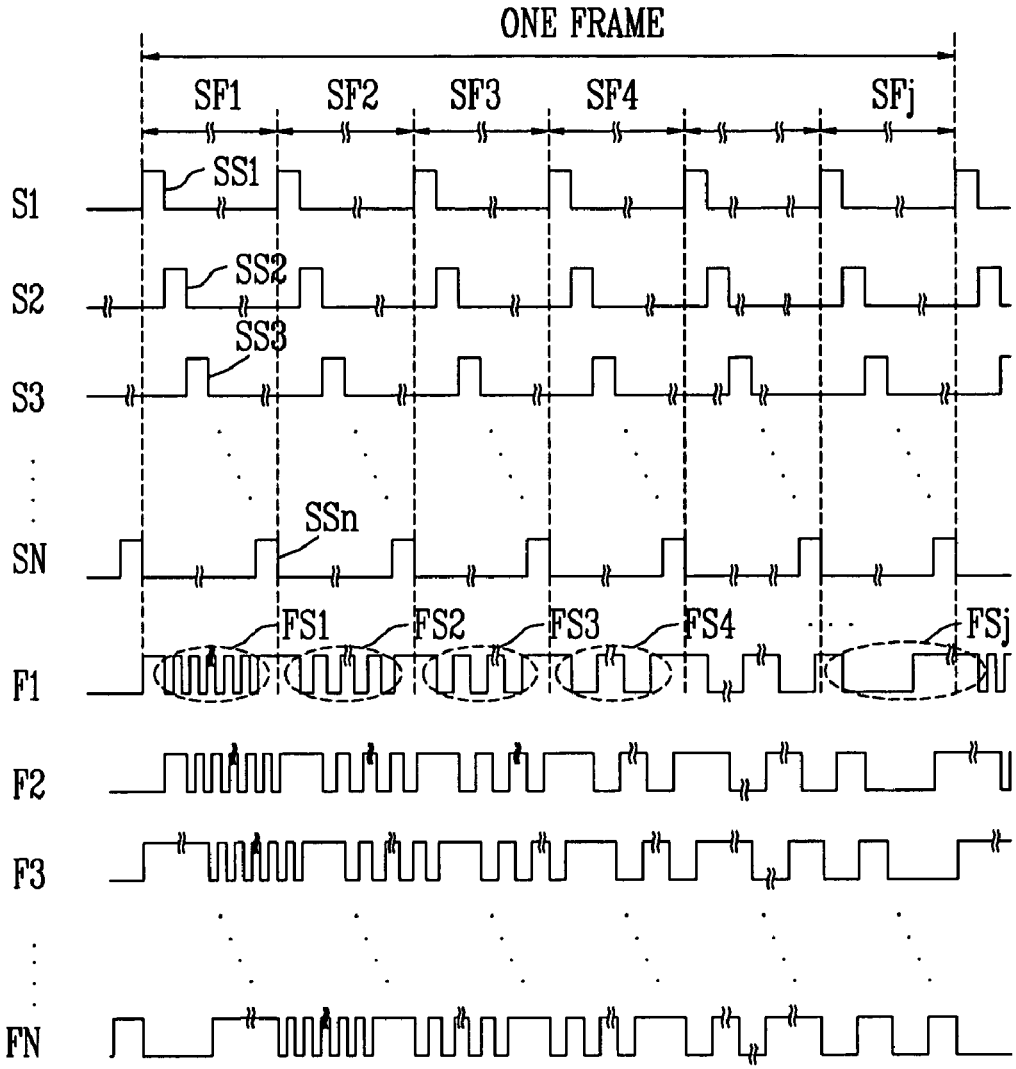
FIG. 11 shows waveforms of signals for driving the organic light emitting display comprising the pixel of FIG. 10.

FIG. 10 is a circuit diagram of a pixel provided in an organic light emitting display according to a second embodiment of the invention, and FIG. 11 shows waveforms of drive signals for the organic light emitting display comprising the pixel according to the second embodiment.

Referring to FIGS. 10 and 11, an organic light emitting display comprising a pixel according to the second embodiment of the invention has a configuration similar to that of the first embodiment, except that transistors M1 and M2 of the pixel circuit 140 are different in an impurity type from those of the first embodiment.

According to the second embodiment of the present invention, the organic light emitting display is operated by a manner similar to that of the first embodiment, except for a scan signal for driving n type transistors M1 and M2.

In the second embodiment, each pixel 111 of the organic light emitting display comprises two transistor M1 and M2 and one capacitor C, but is not limited thereto. Each pixel may comprise at least two transistors and at least one capacitor.

In the second embodiment, the respective sub-frames have the same emission period, but the embodiment is not limited to such a feature. Alternatively, the respective sub-frames may have different emission periods to improve gradation representation and picture quality.

Further, the pixel, the organic light emitting display comprising the same, and the driving method thereof according to an embodiment of the invention are applicable to any display apparatus configured to display an image by controlling current.

As described above, embodiments of the invention include a pixel, an organic light emitting display comprising the same, and a driving method thereof, in which desired gradation is represented by the brightness sum of light emitted from an organic light emitting diode according to sub-frames on the basis of a digital data signal and a frequency signal. Thus, in a digital driving manner, the respective sub-frames have the same emission period so that there is enough time for adjustment of the emission period rate, thereby solving a problem of gradation representation due to limited timing.

Further embodiments of the invention include a pixel, an organic light emitting diode comprising the same, and a driving method thereof, in which an image is displayed in a digital driving manner, so that uniform brightness is obtained regardless of manufacturing differences in threshold voltage between transistors provided in the pixel, thereby improving picture quality.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. The scope of the invention is indicated by the appended claims rather than by the foregoing description. All changes which come within the meaning and range of equivalency of the claims are to be embraced within their scope.

What is claimed is:

1. An organic light emitting display comprising:

a pixel portion comprising a plurality of pixels defined by a plurality of scan lines, a plurality of data lines, a plurality of power source lines and a plurality of frequency supplying lines, wherein each pixel is configured to emit light based at least in part on a data signal transmitted through one of the data lines and a periodic frequency signal transmitted through one of the frequency supplying lines, wherein within each of a plurality of sub-frames of a frame the periodic frequency signal has a voltage transition which repeats within each sub-frame with an interval of time between each voltage transition, wherein the duration of the interval of time within each sub-frame is different, and wherein the instantaneous brightness of the light emitted is different in different sub-frames and is based at least in part on the duration of the interval of time between each voltage transition of the periodic frequency signal in each sub-frame;

a data driver configured to feed the data signal to a data line of a particular pixel;

a scan driver configured to feed the scan signal to a scan line of the particular pixel; and a frequency supply configured to supply the frequency signal to a frequency supplying line of the particular pixel, wherein the frequency signal is periodic and has different frequencies and different numbers of periods in different sub-frames, wherein each pixel represents gradation on the basis of a brightness sum of light emitted from the organic light emitting diode in every sub-frame of one frame, wherein the data signal includes a digital data signal having i bits corresponding to each sub-frame, where i is a positive integer, wherein the frequency supply is configured to supply the frequency signal corresponding to each sub-frame to the frequency supplying line, and wherein the frequency supply comprises:

a shift register part configured to generate a starting signal and a bit selection signal corresponding to each sub-frame, a counter part configured to start in response to the starting signal and generate $1^{st}$ through $N^{th}$ frequency signals at different frequencies according to input clock signals, and a selector configured to select one of the $1^{st}$ through $N^{th}$ frequency signals supplied from the counter in correspondence to the bit selection signal, and supply the selected frequency signal to the frequency supplying line.

2. The organic light emitting display according to claim 1, wherein the frequency of the frequency signal is reduced as the bit position of the digital data signal approaches a most significant bit.

3. The organic light emitting display according to claim 1, wherein the frequency signal is supplied and synchronized with the scan signal transmitted to the scan line.

4. The organic light emitting display according to claim 1, wherein each pixel comprises:

a pixel circuit configured to output current through the power source line in correspondence to the data signal and the frequency signal; and an organic light emitting diode configured to emit light based on the current output from the pixel circuit.

5. The organic light emitting display according to claim 4, wherein the pixel circuit comprises:

a first transistor controlled by the scan signal transmitted through the scan line, and configured to output the data signal transmitted through the data line;

a second transistor connected between the power source line and the organic light emitting diode, and configured to supply the current to the organic light emitting diode; and a capacitor configured to store the data signal supplied from the first transistor, further configured to drive the second transistor on the basis of the stored data signal and the frequency signal transmitted through the frequency supplying line.

* * * * *